US007756461B2

(12) United States Patent
Sato et al.

(10) Patent No.: US 7,756,461 B2
(45) Date of Patent: Jul. 13, 2010

(54) IMAGE FORMING APPARATUS WITH POLISHING ROLLER THAT CHANGES ROTATIONAL DIRECTION DURING A POLISHING MODE

(75) Inventors: Yojiro Sato, Osaka (JP); Yoshihiko Maruyama, Osaka (JP)

(73) Assignee: Kyocera Mita Corporation (JP)

( * ) Notice: Subject to any disclaimer, the term of this patent is extended or adjusted under 35 U.S.C. 154(b) by 256 days.

(21) Appl. No.: 11/985,470

(22) Filed: Nov. 15, 2007

(65) Prior Publication Data

US 2008/0118289 A1 May 22, 2008

(30) Foreign Application Priority Data

Nov. 16, 2006 (JP) ..... 2006-310406

(51) Int. Cl.
*G03G 21/00* (2006.01)

(52) U.S. Cl. ..... 399/349; 399/71

(58) Field of Classification Search ..... 399/349, 399/357, 350, 71, 299, 303
See application file for complete search history.

(56) References Cited

U.S. PATENT DOCUMENTS

| | | | | |
|---|---|---|---|---|
| 4,956,676 | A * | 9/1990 | Fukae et al. | |
| 5,038,228 | A * | 8/1991 | Takada | |
| 5,920,755 | A * | 7/1999 | Nelson | |
| 7,110,696 | B2 * | 9/2006 | Murakami et al. | 399/349 |
| 7,272,354 | B2 * | 9/2007 | Murakami et al. | 399/349 |
| 2006/0204296 | A1 * | 9/2006 | Maruyama et al. | 399/349 |

FOREIGN PATENT DOCUMENTS

| | | | |
|---|---|---|---|
| CN | 1831678 | | 9/2006 |
| JP | 63011982 | A * | 1/1988 |
| JP | 11073076 | A * | 3/1999 |
| JP | 2000081820 | A * | 3/2000 |
| JP | 2004-361775 | | 12/2004 |
| JP | 2004361776 | A * | 12/2004 |
| JP | 2005134776 | A * | 5/2005 |
| JP | 2006119279 | A * | 5/2006 |

OTHER PUBLICATIONS

Hiroyuki Ueda, "Image Forming Device", Dec. 24, 2004, JP2004-361776A, English Translation by Schreiber Translations, Inc.*

* cited by examiner

*Primary Examiner*—Susan S Lee
(74) *Attorney, Agent, or Firm*—Gerald E. Hespos; Michael J. Porco

(57) ABSTRACT

An image forming apparatus has a photosensitive drum (2), a transfer roller (5) above photosensitive drum (2), a transport line (14) that passes between photosensitive drum (2) and the transfer roller (5), a cleaning unit (6) below the transport line (14) and downstream of the photosensitive drum (2), and provided with a cleaning blade (11) and a polishing roller (10) to polish a surface of photosensitive drum (2), and rotation-direction selector (21) to selectively change a rotation direction of the polishing roller (10). The polishing roller (10) is above the cleaning blade (11) and rotationally upstream of photosensitive drum (2) relative to the cleaning blade (11). The rotation-direction selector (21) allows the polishing roller (10) to rotate in the same direction as the photosensitive drum (2) during a polishing mode for polishing the surface of photosensitive drum (2), and in a reverse direction at other times.

7 Claims, 7 Drawing Sheets

IMAGE FORMING APPARATUS WITH POLISHING ROLLER THAT CHANGES ROTATIONAL DIRECTION DURING A POLISHING MODE

BACKGROUND OF THE INVENTION

1. Field of the Invention

The present invention relates to an image forming apparatus, such as a printer, a copy machine or a facsimile machine.

2. Description of the Related Art

Generally, in an image forming apparatus, after electrostatically charging an outer peripheral surface of a photosensitive drum serving as an image bearing member, in a uniform manner, the photosensitive drum is exposed to light according to image data to form an electrostatic latent image on the photosensitive drum. Then, the electrostatic latent image is developed with toner into a toner image, and the toner image formed on the photosensitive drum is transferred onto a recording sheet by a transfer roller. The recording sheet is then transported to a fixing unit, where the toner image is fixed onto the recording sheet.

The photosensitive drum includes a so-called "OPC photosensitive drum" formed by coating a metal pipe with an organic material, and a silicon photosensitive drum wherein amorphous silicon is vapor-deposited on the outer peripheral surface thereof. The silicon photosensitive drum has high surface hardness, excellent wear resistance and high durability.

Although excellent wear resistance is an advantage of the silicon photosensitive drum, it also has a negative side. For example, the silicon photosensitive drum involves a problem about image deletion occurring under high-temperature/high-humidity environments to cause fogging or blurring of images. The image deletion is attributed to a phenomenon that a charging product (i.e., a product generated during the charging process) accumulated on the outer peripheral surface of the photosensitive drum absorbs water under a high-humidity environment and disarranges an electrostatic latent image. Thus, it is necessary to abrasively remove an oxide consisting of the charging product accumulated on the outer peripheral surface of the photosensitive drum, so as to prevent occurrence of the image deletion.

Typically, a sponge roller is used as a means to polish the outer peripheral surface of the photosensitive drum. The sponge roller is disposed to be in press contact with the surface of the photosensitive drum on an upstream side relative to a cleaning blade, and adapted to be rotated at a peripheral speed having a certain difference from that of the outer peripheral surface of the photosensitive drum so as to perform polishing using toner including abrasive particles. The toner comprises a binder resin serving as matrix particles thereof, and an abrasive, such as silica, alumina, zirconia or titania, attached on surfaces of the matrix particles. The toner is used for forming an image by itself, and a remaining part of the toner untransferred in a transfer unit is also used for polishing the outer peripheral surface of the photosensitive drum.

There has been known a technique of performing the polishing using a cleaning unit 100 which comprises a polishing roller 101 and a cleaning blade 102, wherein the polishing roller 101 is arranged to be located below the cleaning blade 102, as shown in FIG. 6 (see, for example, JP 2004-361775A). In this arrangement, when the polishing roller 101 is rotated in a direction reverse to that of a photosensitive drum 110, a toner pool B is formed around a nip zone between the polishing roller 101 and the photosensitive drum 110 (specifically, the nip zone and an outlet area thereof) to hold toner having an abrasive attached thereon, so that an outer peripheral surface of the photosensitive drum 110 can be effectively polished. However, if the toner is excessively accumulated in the toner holding space B even though a part of the toner in the toner pool B is attached onto an outer peripheral surface of the polishing roller 101 along with the rotation of the polishing roller 101 and scraped off by a scraper 103, another toner pool C will be formed around the polishing roller 101, e.g., on a bottom of the cleaning unit 100. This is likely to cause a problem that accumulated toner in the toner pool C spills out of the cleaning unit 100 and falls onto a recording sheet to stain an image thereon.

As one of the measures for preventing such an image stain due to falling of toner, it is contemplated that the cleaning unit 100 illustrated in FIG. 6 is turned upside down to allow the polishing roller 101 to be located above the cleaning blade 102. However, in the arrangement where the cleaning unit is turned upside down to allow the polishing roller to be located above the cleaning blade, it is assumed that the surface of the photosensitive drum cannot be adequately polished. Specifically, if the polishing roller is designed to be rotated in a reverse direction to a rotation direction of the photosensitive drum, a toner pool cannot be formed around an outlet area of the nip zone between the polishing roller and the photosensitive drum to preclude effective polishing. Conversely, if the polishing roller is designed to be rotated in the same direction as the rotation direction of the photosensitive drum, undesirable jitter will be caused by rotational fluctuation of the photosensitive drum, although polishing is effectively performed based on strong stress between the polishing roller and the photosensitive drum.

SUMMARY OF THE INVENTION

In view of the above problems in the conventional techniques, it is an object of the present invention to provide an image forming apparatus capable of preventing occurrence of a stain on a transfer material due to falling of toner.

In order to achieve this object, the present invention provides an image forming apparatus comprising an image bearing member adapted to be rotated, a transferring member disposed above the image bearing member, a transfer-material transport line arranged to pass through between the image bearing member and the transferring member, a cleaning unit disposed below the transport line and on a rotationally downstream side of the image bearing member relative to the transferring member, and provided with a cleaning blade and a polishing roller adapted to polish a surface of the image bearing member, and rotation-direction selector means adapted to selectively change a rotation direction of the polishing roller. In the image forming apparatus, the polishing roller is disposed above the cleaning blade and on a rotationally upstream side of the image bearing member relative to the cleaning blade, and the rotation-direction selector means is operable to allow the polishing roller to be selectively rotated in the same direction as a rotation direction of the image bearing member during a polishing mode for polishing the surface of the image bearing member, and in a reverse direction to the rotation direction of the image bearing member during a period other than the polishing mode.

In the image forming apparatus of the present invention, the image bearing member is rotated in a direction for passing through the transferring member and the cleaning unit in this order, and the cleaning unit is located below the transport line. This makes it possible to keep toner attached on the image bearing member and scraped off by the cleaning unit from falling onto a transfer material (e.g., a recording sheet) so as to prevent the transfer material from being stained. In the cleaning unit, the polishing roller is disposed above the cleaning blade and on the rotationally upstream side of the image bearing member relative to the cleaning blade. Thus, when the polishing roller is rotated in the reverse direction to the rotation direction of the image bearing member, an outlet area of a nip zone between the polishing roller and the image bearing member is located on a lower side of the nip zone, and thereby no toner pool is formed to preclude the polishing roller from polishing the surface of the image bearing member. Therefore, during the polishing mode for polishing the surface of the image bearing member, the polishing roller is rotated in the same direction as the rotation direction of the image bearing member to allow the outlet area of the nip zone to be located on an upper side of the nip zone so as to form a toner pool and enable the polishing roller to polish the surface of the image bearing member. Then, during a period other than the polishing mode, the rotation direction of the polishing roller will be changed to be reverse to that of the image bearing member.

These and other objects, features and advantages of the invention will become apparent upon reading the following detailed description along with the accompanying drawings.

DETAILED DESCRIPTION OF THE PREFERRED EMBODIMENTS

The present invention will now be specifically described.

Figure 1:
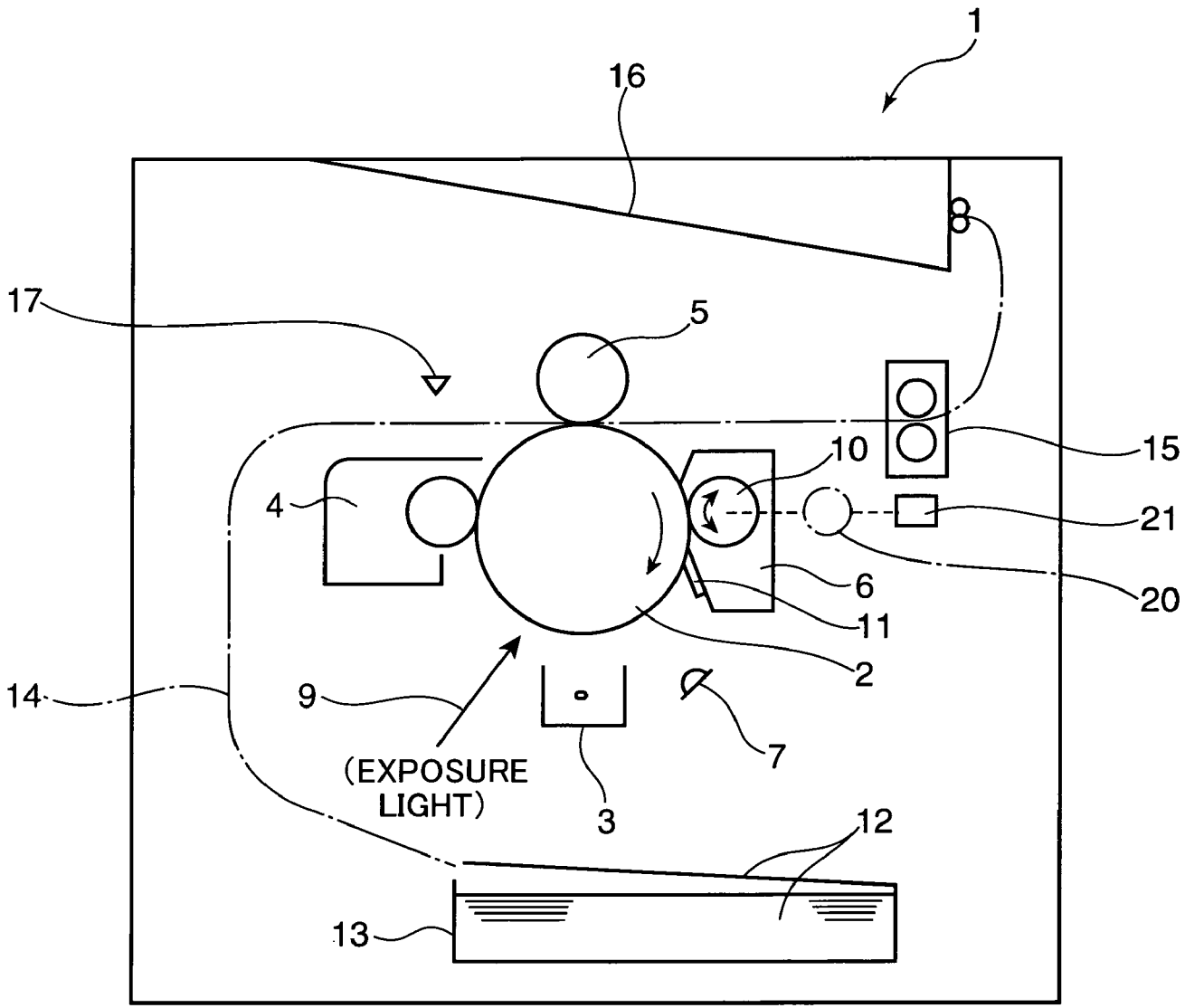
FIG. 1 is a front view showing an image forming apparatus according to a first embodiment of the present invention.

FIG. 1 is a front view showing an image forming apparatus according to a first embodiment of the present invention. This image forming apparatus 1 comprises an approximately columnar-shaped photosensitive drum serving as an image bearing member and having a surface made of amorphous silicon. This image forming apparatus 1 further includes an electrostatic charger 3, a development unit 4, a transfer roller 5 serving as a transferring member, a cleaning unit 6 and a charge eraser 7, which are arranged along a rotation direction of the photosensitive drum 2 in this order. The cleaning unit 6 includes a polishing roller 10 disposed on a rotationally upstream side of the photosensitive drum 2, and a cleaning blade 11 disposed on a rotationally downstream side of the photosensitive drum 2 relative to the photosensitive drum 2.

The image forming apparatus 1 is designed to form an image through the following process. After electrostatically charging an outer peripheral surface of the photosensitive drum 2 in a uniform manner using the electrostatic charger 3, the photosensitive drum 2 is subjected to exposure by irradiating the surface thereof with laser light 9 according to image data, so that an electrostatic latent image is formed on the photosensitive drum 3. Then, the electrostatic latent image on the photosensitive drum 3 is developed into a toner image by the development unit 4, and the toner image on the photosensitive drum 2 is transferred onto a transfer material, e.g., a recording sheet 12, by the transfer roller 5. During the transfer process, a transfer bias potential is applied between the photosensitive drum 2 and the transfer roller 5 to allow electrostatically-charged toner to be smoothly moved onto the recording sheet 12.

After the transfer process, residual toner on the photosensitive drum 2 is attached onto the polishing roller 10 through a polishing action of the polishing roller 10 to the photosensitive drum 2, and collected by the cleaning blade 11. Then, a residual potential is erased by the charge eraser 7. Subsequently, the surface of the photosensitive drum 2 is electrostatically re-charged by the electrostatic charger 3, and the above image forming process will be repeated.

The recording sheet 12 is fed from a sheet cassette 13, and transported along a transport line 14. When the recording sheet 12 is sent between the photosensitive drum 2 and the transfer roller 5, the toner image on the photosensitive drum 2 is transferred onto the recording sheet 12 by the transfer roller 5. Then, the recording sheet 12 is ejected into a catch tray 16 through the fixing unit 15. A registration sensor 17 is disposed on an upstream side of the transport line 14 roller relative to the transfer roller 5. The registration sensor 17 is adapted to detect leading and trailing edges of the recording sheet based on an on/off action thereof so as to perform an operation of registering between the toner image on the photosensitive drum 2 and the recording sheet 12 and others.

Figure 2:
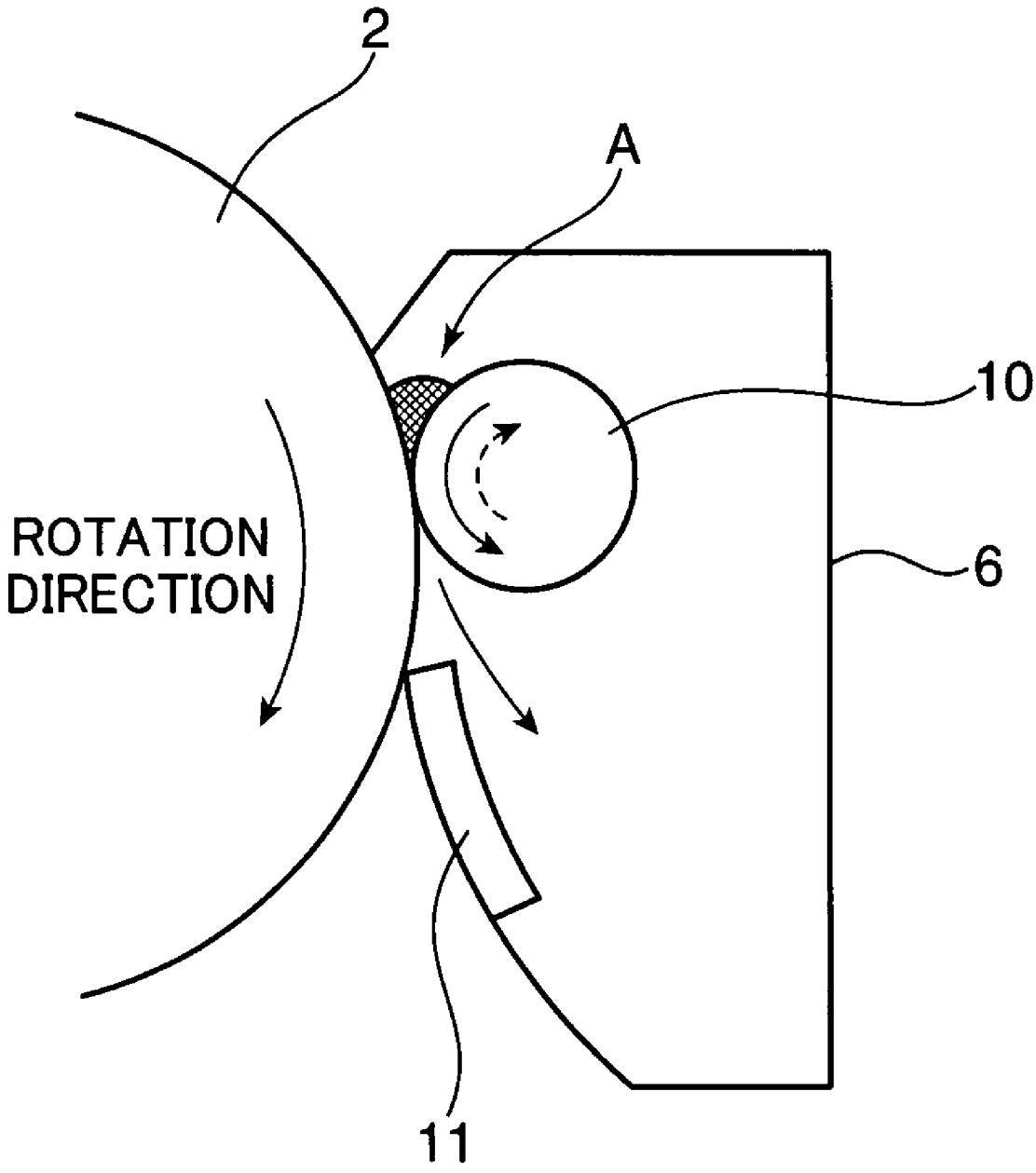
FIG. 2 is a fragmentary front view of the image forming apparatus according to the first embodiment.

In the image forming apparatus 1 designed as described above, the transfer roller 5 is disposed above the photosensitive drum 2, and the transport line 14 is arranged to pass through between the photosensitive drum 2 and the transfer roller 5. The cleaning unit 6 is disposed below the transport line 14 and on a rotationally downstream side of the photosensitive drum 2 relative to the transfer roller 5 (i.e., disposed below the transport line 14 and on a downstream side relative to the transfer roller 5 in the rotation direction of the photosensitive drum 2), wherein, as shown in FIG. 2, the polishing roller 10 is disposed above the cleaning blade 11 and on a rotationally upstream side of the photosensitive drum 2 relative to the cleaning blade 11 (i.e., disposed above the cleaning blade 11 and on an upstream side relative to the cleaning blade 11 in the rotation direction of the photosensitive drum 2).

The polishing roller 10 is adapted to be controllably driven by a drive motor 20 rotatable in both normal and reverse directions. Specifically, the drive motor 20 is adapted to be changed in rotation direction between the normal and reverse directions by a selector switch 21, for example, operable to change a direction for applying a voltage to the drive motor 20. The selector switch 21 serves as rotation-direction selector means.

A peripheral speed ratio of the polishing roller 10 to the photosensitive drum 2 is set, for example, at 0.9 (i.e., the polishing roller 10 is rotated at a peripheral speed less than that of the photosensitive drum 2) in both the normal and reverse directions. It is understood that the peripheral speed ratio is not limited to 0.9, in interpretation of the scope of the present invention.

As above, in the image forming apparatus 1 according to the first embodiment, the photosensitive drum 2 is rotated in a direction for passing through the transfer roller 5 and the cleaning unit 6 in this order, and the cleaning unit 6 is located below the transport line 14. This makes it possible to keep toner attached on the photosensitive drum 2 and scraped off by the cleaning unit 6 from falling onto the recording sheet 12 transported along the transport line 14 so as to prevent the transfer sheet 12 from being stained.

In the cleaning unit 6, the polishing roller 10 is disposed above the cleaning blade 11 and on the rotationally upstream side of the photosensitive drum 2 relative to the cleaning blade 11. Thus, when the polishing roller 10 is rotated in the reverse direction (indicated by the solid line in FIG. 2) to the rotation direction of the photosensitive drum 2, an outlet area of a nip zone between the polishing roller 10 and the photosensitive drum 2 is located on a lower side of the nip zone, and thereby no toner pool is formed to preclude the polishing roller 10 from polishing the surface of the photosensitive drum 2. Therefore, during a polishing mode for polishing the surface of the photosensitive drum 2, the polishing roller 10 is rotated in the same direction (indicated by the broken line in FIG. 2) as the rotation direction of the photosensitive drum 2, according to a switching operation of the selector switch 21. Thus, the outlet area of the nip zone is located on an upper side of the nip zone so as to form a toner pool and enable the polishing roller 10 to polish the surface of the photosensitive drum 2.

Then, during a period other than the polishing mode, the rotation direction of the polishing roller 10 will be changed to be reverse to that of the photosensitive drum 2 (i.e., to the direction indicated by the solid line in FIG. 2), according to the switching operation of the selector switch 21.

Figures 3A, 3B, 3C:
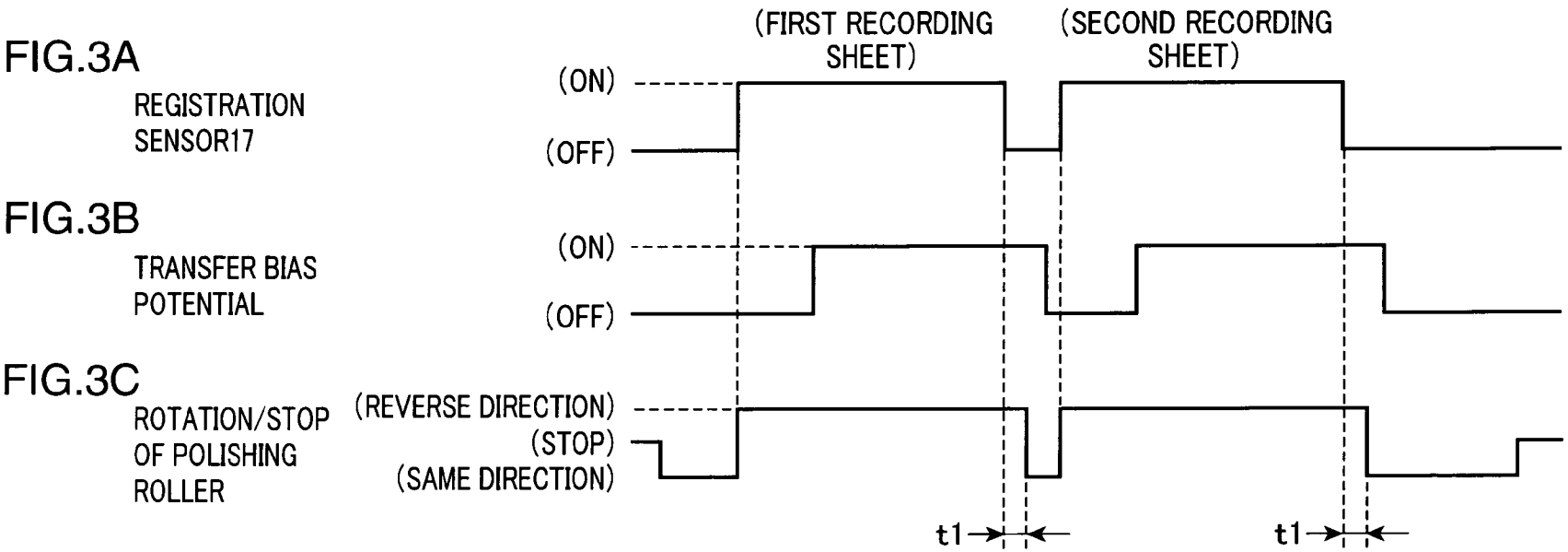
FIGS. 3A to 3C are explanatory charts showing a timing of selectively changing a rotation direction of a polishing roller.

FIGS. 3A to 3C are explanatory charts showing a timing of selectively changing the rotation direction of the polishing roller. FIGS. 3A to 3C show one example where two recording sheets are continuously printed.

When the registration sensor 17 detects a leading edge of a first recording sheet 12 (i.e., the registration sensor 17 is turned on) as shown in FIG. 3A, the polishing roller 10 in a stop state is rotated in the reverse direction to the rotation direction of the photosensitive drum 2, as shown in FIG. 3C. Then, when a predetermined time has elapsed after the registration sensor 17 detects the leading edge of the first recording sheet 12, a transfer bias potential is applied to the transfer roller 5, as shown in FIG. 3B.

Subsequently, the registration sensor 17 detects a trailing edge of the first recording sheet 12 (i.e., the registration sensor 17 is turned off) as shown in FIG. 3A, the polishing roller 10 is rotated in the same direction as the rotation direction of the photosensitive drum 2, as shown in FIG. 3C. A time t1 is equivalent to a time required for the trailing edge of the first recording sheet 12 at the registration sensor 17 to reach the transfer roller 5. Then, when a predetermined time has elapsed after the registration sensor 17 detects the trailing edge of the first recording sheet 12, the operation of applying the transfer bias potential is turned off, as shown in FIG. 3B.

After completion of the printing for the first recording sheet, the same control as that described above is performed in a period from detection of a leading edge of a second recording sheet 12 by the registration sensor 17 (turn-on of the registration sensor 17) through until detection of a trailing edge of the second recording sheet 12 by the registration sensor 17 (turn-off of the registration sensor 17). Then, with a delay time from the detection of the trailing edge by a time t1, the rotation direction of the polishing roller 10 is changed from the reverse direction the rotation direction of the photosensitive drum 2, to the same direction as the rotation direction of the photosensitive drum 2. Then, after an elapse of a predetermined time, the polishing roller 10 is stopped. Further, when a predetermined time has elapsed after the detection of the trailing edge of the second recording sheet 12, the operation of applying the transfer bias potential is turned off, as shown in FIG. 3B.

The control illustrated in FIGS. 3A to 3B is one example where the number of recording sheets is two, as mentioned above. A control for one recording sheet (performing a printing operation once) is equivalent to the above control for the second recording sheet (the last half of the control in FIG. 3). In a control for a number N (three or more) of recording sheets, the above control for the first recording sheet is repeatedly performed (N−1) times, and then the above control for the second recording sheet (the last half of the control in FIG. 3) is finally performed.

While the above description has been made based on an example where the polishing mode is configured to be performed every time a printing operation for each of a plurality of recording sheets is completed, i.e., with respect to each recording sheet, the present invention is not limited to such a manner, but the polishing mode may be configured to be performed after a printing operation for one or more recording sheets is fully completed. A timing of setting in the polishing mode includes any timing during a period when no printing operation is performed, and a timing just after completion of a printing operation. The image forming apparatus 1 may be additionally provided with a polishing mode switch adapted to be manually operated so as to select one of plural types of polishing modes.

Figures 4A, 4B:
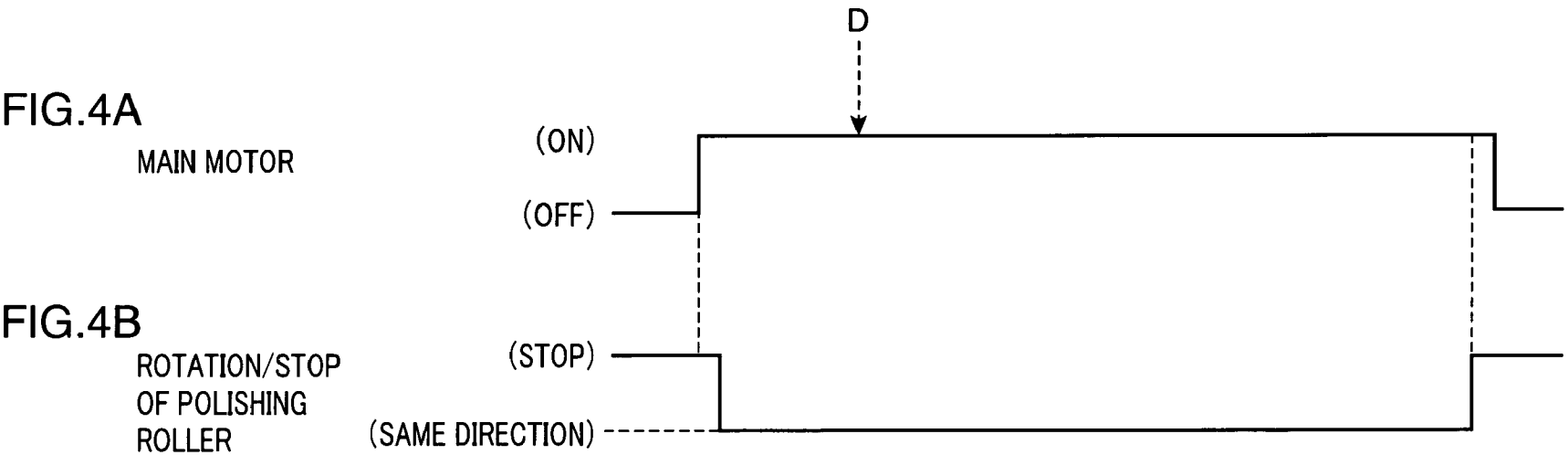
FIGS. 4A and 4B are charts showing a relationship between the rotation direction of the polishing roller and an ON/OFF state of a main motor adapted to controllably rotate a photosensitive drum.

FIGS. 4A and 4B are charts showing a relationship between the rotation direction of the polishing roller and an ON/OFF state of a main motor adapted to controllably rotate the photosensitive drum.

When a predetermined time has elapsed after the main motor in its OFF state for stopping the rotation of the photosensitive drum 2 is changed to its ON state to rotate the photosensitive drum 2, as shown in FIG. 4A, the polishing roller 10 in the stop state is rotated in the same direction as the rotation direction of the photosensitive drum 2. Then, toner is developed on the photosensitive drum 2, for example, to have a black stripe shape, at a timing D illustrated in FIG. 4A, and the black stripe-shaped toner image is polished by the polishing roller 10. This makes it possible to increase an amount of toner in a toner pool A illustrated in FIG. 2 so as to prevent insufficiency in amount of toner required for polishing the surface of the photosensitive drum 2.

While the transfer roller 5 in the first embodiment is disposed above the photosensitive drum 2, the present invention is not limited to such an arrangement. For example, the transfer roller 5 may be disposed above any position falling within an upper half of the photosensitive drum 2. The point is to allow the cleaning unit 6 to be located below the transport line 14.

As to a positional relationship between the polishing roller 10 and the cleaning blade 11 which constitute the cleaning unit 6, it is not essential that the polishing roller 10 is located directly above the cleaning blade 11. It is understood that the polishing roller 10 may be located obliquely above the cleaning blade 11.

While the photosensitive drum 2 in the first embodiment has a surface coated with amorphous silicon, the present invention is not limited to this structure. For example, the aforementioned OPC photosensitive drum may be employed in the present invention.

While the first embodiment has been described based on one example where the present invention is applied to the image forming apparatus having a single photosensitive drum, an applicable scope of the present invention is not limited to such a type. For example, as shown in FIGS. 5A, 5B and 5C, the present invention may also be applied to a cleaning unit 6A for a photosensitive member 2A or a cleaning unit 45 for an intermediate transferring member, in an image forming apparatus having two or more photosensitive drums.

Figure 5A:
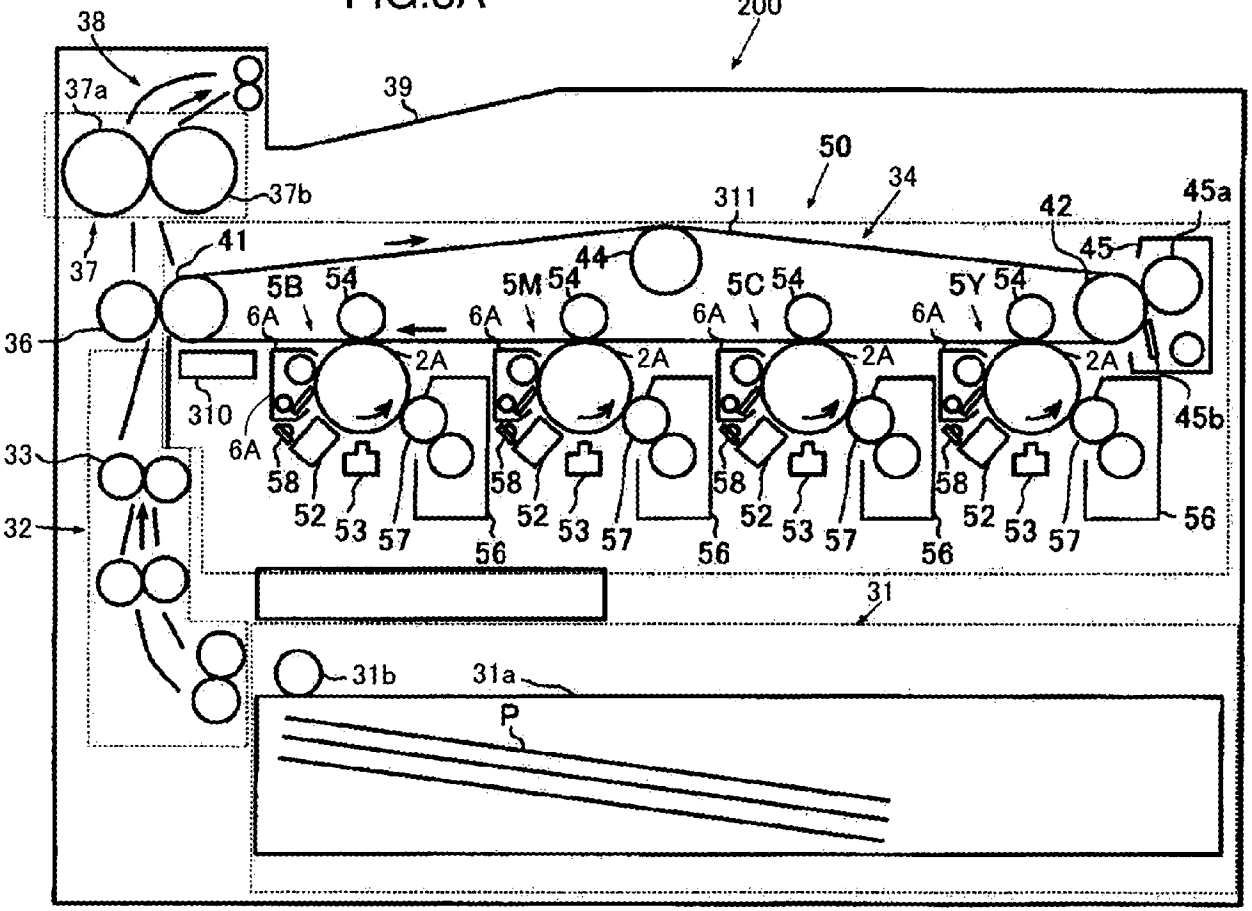
FIG. 5A is a front view showing an image forming apparatus according to a second embodiment of the present invention.
Figure 5B:
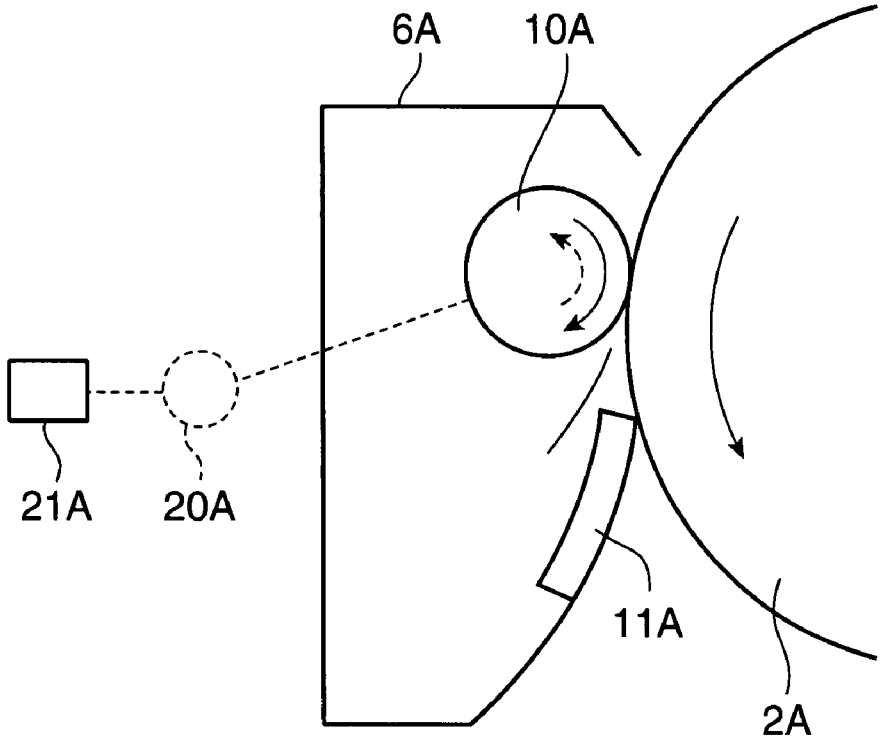
FIG. 5B is a schematic diagram showing a relationship between a photosensitive drum and a cleaning unit in the image forming apparatus according to the second embodiment.
Figure 5C:
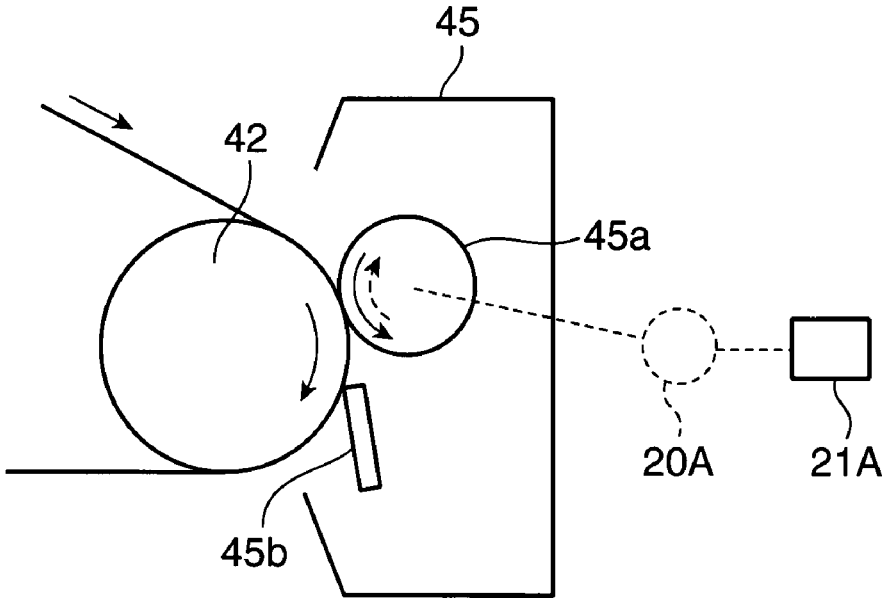
FIG. 5C is a schematic diagram showing a relationship between an intermediate transfer belt and the cleaning unit in the image forming apparatus according to the second embodiment.
Figure 6:
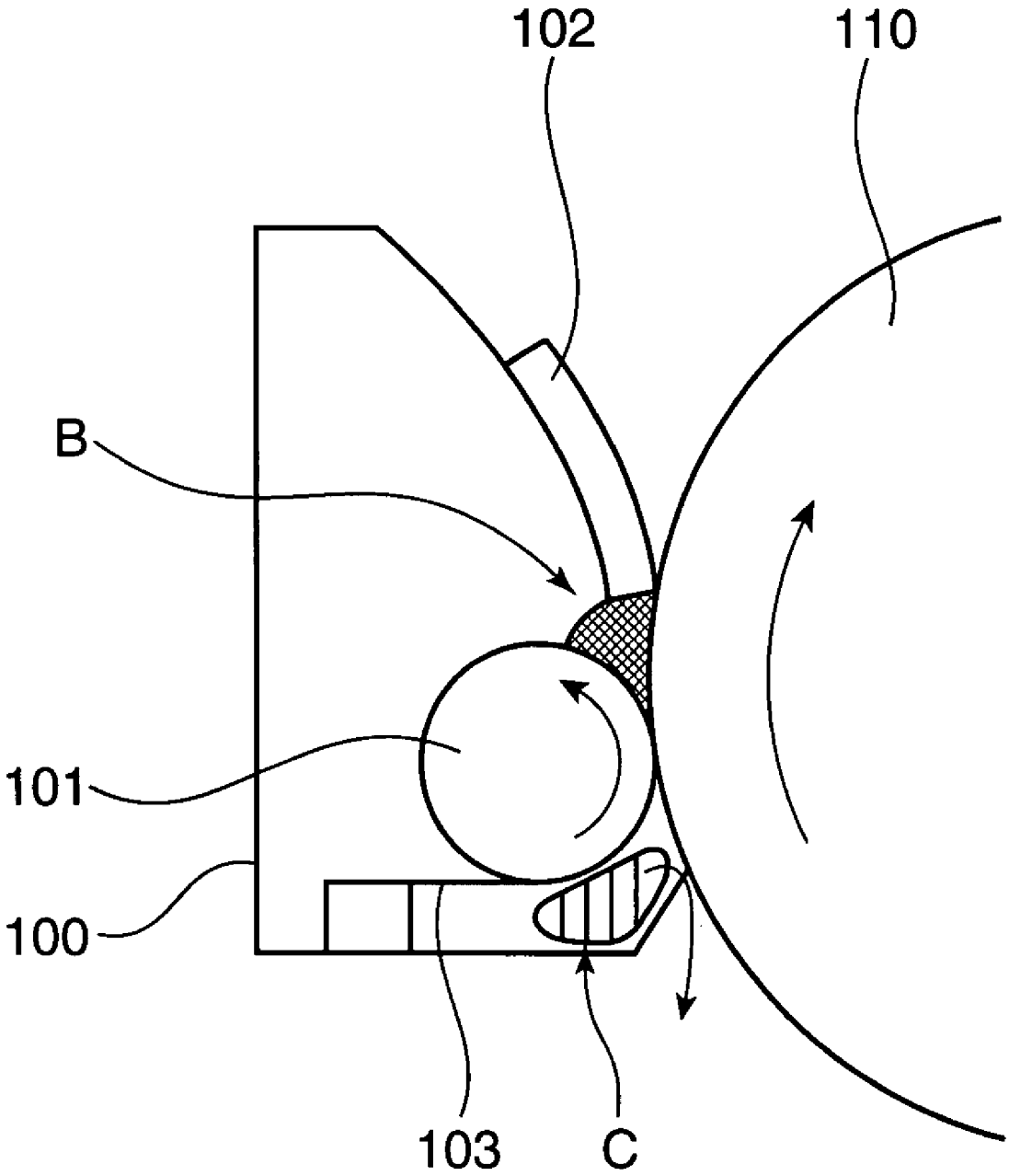
PRIOR ART FIG.6
FIG. 6 is a schematic diagram showing a relationship between a photosensitive drum and a cleaning unit in a conventional image forming apparatus.

FIG. 5A is a schematic front view showing a printer 200 as a tandem-type color image forming apparatus, according to a second embodiment of the present invention.

The printer 200 comprises a sheet feeding section 31, a vertical transport path 32, a registration roller pair 33, a belt transport section 34, an image forming section 50, a secondary transfer section 36, a fixing section 37, an ejection transport path 38, a catch tray 39, an optical detection device 310 and a control section (not shown). The image forming section 50 includes four image forming mechanisms consisting of a first image forming mechanism 5B, a second image forming mechanism 5M, a third image forming mechanism 5C and a fourth image forming mechanism 5Y.

The printer 200 is designed to form an image through the following process. A sheet P is fed from a sheet feeding cassette 31*a* of the sheet feeding section 31 to the vertical transport path 32 through a pickup roller 31*b*, and transported to the secondary transfer section 36 through the registration roller pair 33.

In the image forming section 50, an intermediate transfer belt 311 as a endless belt is circulated in a direction indicated by the arrows in FIG. 5A according to a drive roller 41. Yellow, cyan, magenta and block toner images formed on respective photosensitive drums 2A each provided in a corresponding one of the image forming mechanisms 5Y, 5C, 5M, 5B to serve as an image bearing member are sequentially transferred onto the intermediate transfer belt 311 in a superimposed manner to form a color image.

The color image formed in the image forming section 50 is secondarily transferred by the secondary transfer section 36 from the intermediate transfer belt 311 onto the sheet P transported from the sheet feeding cassette 31*a*. Thus, the color image is formed on the sheet P.

Then, the sheet P having the unfixed color image transferred thereonto is separated from the intermediate transfer belt 311, and transported to the fixing section 37. In the fixing section 37, a color-image fixing operation is performed by supplying heat to a nip zone defined between a fixing roller 37*a* and a pressing roller 37*b* in a press contact with the fixing roller 37*a*, in an amount required for fixing the color image onto the sheet P. After completion of the fixing operation in the fixing section, the sheet P is ejected to the catch tray 39 through the ejection transport path 38. The fixing roller 37*a* has a heater (not shown) incorporated therein and adapted to controllably generate heat in an amount required for the fixing.

The following description will be made about the structure of the image forming section 50 which is a major component of the printer 200. The image forming section 50 comprises the belt transport section 34, the first to fourth image forming mechanisms 5B, 5M, 5C, 5Y each including a development unit 56, and an intermediate-transfer cleaning unit 45.

As shown in FIG. 5A, the belt transport section 34 comprises the drive roller 41, a driven roller 42, and the endless-type intermediate transfer belt 311 wound around the two rollers 41, 42. The intermediate transfer belt 311 is kept in an appropriately tensioned state by a tension roller 44. In this state, according to a driving force transmitted from a drive motor (not shown), the drive roller 41 is driven in such a manner that a circulation speed (i.e., feed speed) of the intermediate transfer belt 311 in the belt transport section 34 has a steady value approximately equal to a speed of an outer peripheral surface of the photosensitive drum 2 in each of the image forming mechanisms.

The first to fourth image forming mechanisms 5B, 5M, 5C, 5Y are aligned along and below the belt transport section 34. The yellow (Y), cyan (C), magenta (M) and block (B) image forming mechanisms are arranged from an upstream side to a downstream side of a lower region of the intermediate transfer belt 311, i.e., in a sheet transport direction, in this order. Thus, the same element or component in each of the first to fourth image forming mechanisms 5B, 5M, 5C, 5Y is defined by the same reference numeral or code. In the following description about the first to fourth image forming mechanisms 5B, 5M, 5C, 5Y, they will be simply described as "image forming mechanism(s)" without the identification codes "B", "M", "C", "Y", except when it is necessary to discriminate against each other.

The image forming mechanism includes the photosensitive drum 2A, a main electrostatically charging unit 52, an exposure unit 53, a primary transfer member (transfer roller) 54, a cleaning unit 6A and the development unit 56. These components are assembled to a housing made of resin or the like to form a single unit, and then mounted to a body of the image forming apparatus.

An amorphous silicon drum is used as the photosensitive drum 2A. The main electrostatically charging unit 52 is adapted to electrostatically charge an outer peripheral surface of the photosensitive drum 2A in such a manner that a dark potential at a development position has a predetermined value. The exposure unit 53 is adapted to emit light onto the electrostatically-charged surface of the photosensitive drum 2A according to image information to form an electrostatic latent image on the surface of the photosensitive drum 2A. In the second embodiment, an LPH (LED print head) is used as the exposure unit 53. Alternatively, an LSU (laser scanning unit) may also be used as the exposure unit 53.

The photosensitive drum 2A is adapted to be rotated by a rotationally driving mechanism, wherein a rotation speed thereof is controlled by a microcomputer or the like. Specifically, an appropriate rotation speed is derived from a calculation result based on an output of the optical detection device 310 adapted to detect a surface state of the intermediate transfer belt 311, and the photosensitive drum 2A is controlled to have the derived rotation speed.

The development unit 56 is adapted to apply toner particles supplied from a toner tank (not shown), onto a surface of a development roller 57, and supply the toner particles from the development roller 57 to the electrostatic latent image formed on the photosensitive drum 2A, so as to develop a toner image on the photosensitive drum 2A.

For example, a dark potential of the photosensitive drum 2A, a development bias and an exposure potential may be set at +300 V, +200 V and +20 V, respectively. A difference between the development bias and the exposure potential is a so-called "contrast potential". For example, in a process of forming a black toner image, the dark potential corresponds to a white portion of the image, and the exposure potential corresponds to a black portion of the image. The toner image developed from the electrostatic latent image in the above manner is transferred onto a surface of the intermediate transfer belt 311 of the belt transport section 34, in a transfer nip between the photosensitive drum 2A and the primary transfer member 54. The primary transfer member 54 consists of a transfer roller. The transfer roller 54 is adapted to be applied with a transfer bias set to have a reverse polarity to that of a surface potential of the photosensitive drum 2A, specifically, in the range of −100 to −1000 V, so as to allow the toner image formed on the photosensitive drum 2A to be transferred to the intermediate transfer belt.

Untransferred toner on the photosensitive drum 2A is removed by the cleaning unit 6A. Then, in order to lower a residual potential of the surface of the photosensitive drum 2A, a charge on the photosensitive drum 2A is erased by an electrostatic eraser lamp 58 to stand ready to perform a series of next process. Each of the potentials in the image forming process may be set at an optimal value depending on characteristics of the photosensitive drum 2A, characteristics of toner, environments, etc. Based on the above operation of the image forming mechanism, black, magenta, cyan and yellow images are developed on the respective photosensitive drums 2A in the first to fourth image forming mechanisms 5B, 5M, 5C, 5Y, and sequentially transferred to the intermediate transfer belt 311 in a superimposed manner without misregistration to form a single color image.

The intermediate-transfer cleaning unit 45 comprises an intermediate-transfer cleaning roller 45*a* and an intermediate-transfer cleaning blade 45*b*. The intermediate-transfer cleaning roller 45*a* is disposed to be in press contact with the intermediate transfer belt 311, and adapted to be rotated in the same direction as the circulation direction of the intermediate transfer belt 311. The intermediate-transfer cleaning blade 45*b* is disposed to be in contact with the intermediate transfer belt 311 on the downstream side in the circulation direction of the lower region of the intermediate transfer belt 311 relative to a position of the intermediate-transfer cleaning roller 45*a*, so as to scrape off untransferred residual toner on the intermediate transfer belt 311.

A reflection-type sensor is employed as the optical detection device 310. The optical detection device 310 is used for correcting the rotation speed of the photosensitive drum 2A and for measuring a concentration of toner transferred to the intermediate transfer belt 311 so as to correct an image density.

As shown in FIG. 5A, the optical detection device 310 is disposed below the intermediate transfer belt 311 and at a position on a downstream most side of the image forming mechanisms and just before the drive roller 4, in the circulation direction of the lower region of the intermediate transfer belt 311. The optical detection device 310 is adapted to detect an adhesive state of toner transferred from the image forming mechanisms to the intermediate transfer belt 311 and a surface state of the intermediate transfer belt 311 in a non-contact manner.

As shown in FIG. 5B, the cleaning unit 6A is disposed on a rotationally downstream side of the photosensitive drum 2A relative to the intermediate transfer belt 311 (i.e., disposed on a downstream side relative to the intermediate transfer belt 311 in the rotation direction of the photosensitive drum 2A), and the polishing roller 10A is disposed above the cleaning blade 11A and on a rotationally upstream side of the photosensitive drum 2A relative to the cleaning blade 11A (i.e., disposed above the cleaning blade 11A and on an upstream side relative to the cleaning blade 11A in the rotation direction of the photosensitive drum 2A).

The polishing roller 10A is adapted to be controllably driven by a drive motor 20A rotatable in both normal and reverse directions. Specifically, the drive motor 20A is adapted to be changed in rotation direction between the normal and reverse directions by a selector switch 21A, for example, operable to change a direction for applying a voltage to the drive motor 20A. The selector switch 21A serves as rotation-direction selector means.

As above, in the image forming apparatus 200 according to the second embodiment, the photosensitive drum 2A is rotated in a direction for passing through the intermediate transfer belt 311 and the cleaning unit 6A in this order, and the cleaning unit 6A is located below the intermediate transfer belt 311. This makes it possible to keep toner attached on the photosensitive drum 2A and scraped off by the cleaning unit 6A from falling onto the intermediate transfer belt 311 so as to prevent the intermediate transfer belt 311, i.e., a recording sheet, from being stained.

The polishing roller having a normal/reverse rotation direction selector mechanism of the present invention can also be applied to the intermediate-transfer cleaning unit 45, as shown in FIG. 5C.

As mentioned above, the image forming apparatus of the present invention comprises an image bearing member adapted to be rotated, a transferring member disposed above the image bearing member, a transfer-material transport line arranged to pass through between the image bearing member and the transferring member, a cleaning unit disposed below the transport line and on a rotationally downstream side of the image bearing member relative to the transferring member, and provided with a cleaning blade and a polishing roller adapted to polish a surface of the image bearing member, and rotation-direction selector means adapted to selectively change a rotation direction of the polishing roller. In the image forming apparatus, the polishing roller is disposed above the cleaning blade and on a rotationally upstream side of the image bearing member relative to the cleaning blade, and the rotation-direction selector means is operable to allow the polishing roller to be selectively rotated in the same direction as a rotation direction of the image bearing member during a polishing mode for polishing the surface of the image bearing member, and in a reverse direction to the rotation direction of the image bearing member during a period other than the polishing mode.

In the image forming apparatus of the present invention, the image bearing member is rotated in a direction for passing through the transferring member and the cleaning unit in this order, and the cleaning unit is located below the transport line. This makes it possible to keep toner attached on the image bearing member and scraped off by the cleaning unit from falling onto a transfer material (e.g., a recording sheet) so as to prevent the transfer material from being stained. In the cleaning unit, the polishing roller is disposed above the cleaning blade and on the rotationally upstream side of the image bearing member relative to the cleaning blade. Thus, when the polishing roller is rotated in the reverse direction to the rotation direction of the image bearing member, an outlet area of a nip zone between the polishing roller and the image bearing member is located on a lower side of the nip zone, and thereby no toner pool is formed to preclude the polishing roller from polishing the surface of the image bearing member. Therefore, during the polishing mode for polishing the surface of the image bearing member, the polishing roller is rotated in the same direction as the rotation direction of the image bearing member to allow the outlet area of the nip zone to be located on an upper side of the nip zone so as to form a toner pool and enable the polishing roller to polish the surface of the image bearing member. Then, during a period other than the polishing mode, the rotation direction of the polishing roller will be changed to be reverse to that of the image bearing member.

Preferably, in the image forming apparatus of the present invention, the polishing mode is set at a timing when no toner image is formed on the image bearing member.

According to this feature, at the toner-image non-forming timing, i.e., when a recording sheet is not subjected to a printing operation, the operation of polishing the image bearing member is performed. This makes it possible to subject a recording sheet the printing operation without any problem due to the polishing operation.

In the image forming apparatus of the present invention, the rotation-direction selector means may be operable, in response to a predetermined manual operation, to allow the polishing roller to be rotated in the same direction as the rotation direction of the image bearing member for a given time.

According to this feature, in response to a predetermined manual operation, the rotation-direction selector means allows the polishing roller to be controllably rotated in the same direction as the rotation direction of the image bearing member, so as to polish the surface of the image bearing member for a given time. Thus, at any time when a recording sheet is not subjected to the printing operation, the image bearing member can be polished any number of times.

The above image forming apparatus may be designed to develop toner on the image bearing member during the polishing mode so as to increase an amount of toner for use as a polishing abrasive.

According to this feature, the toner image developed during the polishing mode is removed by polishing the surface of the image bearing member, and therefore an amount of toner for use as a polishing abrasive is increased. This makes it possible to prevent insufficiency in amount of toner required for polishing the surface of the image bearing member.

The cleaning unit including the normal/reverse rotation direction selectable polishing roller may be used in an image forming apparatus having a single image bearing member, or may be used in an image forming apparatus having a plurality of image carrying bodies. Further, the normal/reverse rotation direction selectable polishing roller and the rotation-direction selector means in the present invention may be used in a cleaning unit for an intermediate transfer belt.

This application is based on Japanese Patent Application Serial No. 2006-310406, filed in Japan Patent Office on Nov. 16, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a rotatable image bearing member;

a transferring member disposed above said image bearing member;

a transfer-material transport line arranged to pass through between said image bearing member and said transferring member;

a cleaning unit disposed below said transport line and on a rotationally downstream side of said image bearing member relative to said transferring member, said cleaning unit including a cleaning blade and a polishing roller disposed substantially adjacent to a surface of said image bearing member and being configured to polish the surface of said image bearing member; and rotation-direction selector means for selectively changing a rotation direction of said polishing roller, wherein:

said polishing roller is disposed above said cleaning blade and on a rotationally upstream side of said image bearing member relative to said cleaning blade; and said rotation-direction selector means is operable to allow said polishing roller to be selectively rotated in a same direction as a rotation direction of said image bearing member during a polishing mode for polishing the surface of said image bearing member, and in a reverse direction to the rotation direction of said image bearing member during a period other than said polishing mode; and said polishing mode is set at a timing when no toner image is formed on said image bearing member.

2. The image forming apparatus according to claim 1, which is designed to develop toner on said image bearing member during said polishing mode so as to increase an amount of toner for use as a polishing abrasive.

3. An image forming apparatus comprising:

a rotatable image bearing member that is rotatable in a first rotational direction;

a transferring member disposed above said image bearing member;

a transfer-material transport line arranged to pass through between said image bearing member and said transferring member;

a cleaning unit disposed below said transport line and on a rotationally downstream side of said image bearing member relative to said transferring member, said cleaning unit including a cleaning blade and a polishing roller disposed substantially adjacent to a surface of said image bearing member and being configured to polish the surface of said image bearing member; and rotation-direction selector means for selectively changing a rotation direction of said polishing roller, wherein:

said polishing roller is disposed above said cleaning blade and on a rotationally upstream side of said image bearing member relative to said cleaning blade; and said rotation-direction selector means is operable to allow said polishing roller to be selectively rotated in a same direction as a rotation direction of said image bearing member during a polishing mode for polishing the surface of said image bearing member, and in a reverse direction to the rotation direction of said image bearing member during a period other than said polishing mode;

said rotation-direction selector means is operable, in response to a predetermined manual operation, to allow said polishing roller to be rotated in the same direction as the rotation direction of said image bearing member for a given time.

4. The image forming apparatus according to claim 3, which is designed to develop toner on said image bearing member during said polishing mode so as to increase an amount of toner for use as a polishing abrasive.

5. An image forming apparatus comprising:

an image bearing member;

a cleaning unit including a cleaning blade and a polishing roller disposed substantially adjacent to a surface of said image bearing member and being configured to polish the surface of said image bearing member; and rotation-direction selector means for selectively changing a rotation direction of said polishing roller, wherein:

said polishing roller is disposed above said cleaning blade and on a rotationally upstream side of said image bearing member relative to said cleaning blade; and said rotation-direction selector means is operable to allow said polishing roller to be selectively rotated in a same direction as a rotation direction of said image bearing member during a polishing mode for polishing the surface of said image bearing member, and in a reverse direction to the rotation direction of said image bearing member during a period other than said polishing mode; and said polishing mode is set at a timing when no toner image is formed on said image bearing member.

6. The image forming apparatus according to claim 5, wherein said image bearing member is a photosensitive drum.

7. The image forming apparatus according to claim 5, wherein said image bearing member is a plurality of photosensitive drums.

* * * * *